US009815615B2

(12) United States Patent
Doolittle

(10) Patent No.: US 9,815,615 B2
(45) Date of Patent: Nov. 14, 2017

(54) MULTIPLE SEAT SHIPPING CONTAINER

(71) Applicant: Zodiac Seats US LLC, Gainesville, TX (US)

(72) Inventor: Travis D. Doolittle, Little Elm, TX (US)

(73) Assignee: Zodiac Seats US LLC, Gainesville, TX (US)

( * ) Notice: Subject to any disclaimer, the term of this patent is extended or adjusted under 35 U.S.C. 154(b) by 0 days.

(21) Appl. No.: 14/900,882

(22) PCT Filed: Aug. 8, 2014

(86) PCT No.: PCT/US2014/050256

§ 371 (c)(1),
(2) Date: Dec. 22, 2015

(87) PCT Pub. No.: WO2015/023519

PCT Pub. Date: Feb. 19, 2015

(65) Prior Publication Data

US 2016/0145036 A1 May 26, 2016

Related U.S. Application Data

(60) Provisional application No. 61/864,705, filed on Aug. 12, 2013.

(51) Int. Cl.

| | |
|---|---|
| ***B65D 85/62*** | (2006.01) |
| ***B65D 19/06*** | (2006.01) |
| ***B65D 19/44*** | (2006.01) |

(52) U.S. Cl.

CPC ..... *B65D 85/62* (2013.01); *B65D 19/06* (2013.01); *B65D 19/44* (2013.01);
(Continued)

(58) Field of Classification Search

CPC ..... B65D 19/06; B65D 19/44; B65D 85/00; B65D 85/62; B65D 2519/00024;
(Continued)

(56) References Cited

U.S. PATENT DOCUMENTS 2,212,310 A * 8/1940 Wokosin ..... B65D 71/02 206/326
3,642,127 A * 2/1972 Bobb ..... A47C 31/11 206/326

(Continued)

FOREIGN PATENT DOCUMENTS

AU 6445774 7/1985
CN 201170276 Y 12/2008

(Continued)

OTHER PUBLICATIONS

International Patent Application No. PCT/US2014/050256, Search Report and Written Opinion dated Nov. 17, 2014.

(Continued)

*Primary Examiner* — Bryon Gehman
(74) *Attorney, Agent, or Firm* — Kilpatrick Townsend & Stockton LLP; Dean W. Russell; Davidson G. Lucas

(57) ABSTRACT

Disclosed is a multiple seat shipping container (100) that includes a bottom base structure (101) configured to attach one or more first seats (120), a forward wall (103) with a lower portion (103*a*) pivotally attached to a forward side of the bottom base structure, a top wall (104) pivotally attached to an upper portion (103*b*) of the forward wall, the top wall configured to attach one or more second seats (121), and a rear wall (105) attached to a rear side of the bottom base structure. The multiple seat shipping container is configured to fold into a box shape configuration such that the one or more second seats are suspended from the top wall adjacent to the one or more first seats.

20 Claims, 4 Drawing Sheets

(52) U.S. Cl.
CPC ..... *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/0081* (2013.01); *B65D 2519/00094* (2013.01); *B65D 2519/00099* (2013.01); *B65D 2519/00104* (2013.01); *B65D 2519/00164* (2013.01); *B65D 2519/00169* (2013.01); *B65D 2519/00174* (2013.01); *B65D 2519/00199* (2013.01); *B65D 2519/00203* (2013.01); *B65D 2519/00208* (2013.01); *B65D 2519/00273* (2013.01); *B65D 2519/00323* (2013.01); *B65D 2519/00333* (2013.01); *B65D 2519/00497* (2013.01); *B65D 2519/00502* (2013.01); *B65D 2519/00572* (2013.01); *B65D 2519/00611* (2013.01); *B65D 2519/00646* (2013.01); *B65D 2519/00721* (2013.01); *B65D 2519/00791* (2013.01); *B65D 2519/00815* (2013.01); *B65D 2519/00905* (2013.01); *B65D 2585/6882* (2013.01)

(58) Field of Classification Search
CPC ..... B65D 2519/00029; B65D 2519/00034; B65D 2519/00059; B65D 2519/00064; B65D 2519/00069; B65D 2519/00094; B65D 2519/00099; B65D 2519/00104; B65D 2519/00164; B65D 2519/00169; B65D 2519/00174; B65D 2519/00199; B65D 2519/00203; B65D 2519/00208; B65D 2519/00273; B65D 2519/00323; B65D 2519/00333; B65D 2519/00497; B65D 2519/00502; B65D 2519/00572; B65D 2519/00611; B65D 2519/00646; B65D 2519/00721; B65D 2519/00791; B65D 2519/0081; B65D 2519/00815; B65D 2519/00905; B65D 19/12; B65D 21/086; B65D 81/052; B65D 85/48; B65G 49/062
USPC ..... 206/326, 335, 386, 526, 595–600
See application file for complete search history.

(56) References Cited

U.S. PATENT DOCUMENTS

| | | | | | |
|---|---|---|---|---|---|
| 3,670,473 | A * | 6/1972 | Bobb | A47C 31/11 | 206/326 |
| 3,750,872 | A * | 8/1973 | Bobb | A47C 31/11 | 206/326 |
| 4,170,297 | A * | 10/1979 | Johnson | B65D 85/62 | 206/326 |
| 5,575,389 | A * | 11/1996 | Alspach | B60N 2/01508 | 206/386 |
| 7,025,204 | B2 * | 4/2006 | Garcia | B65D 85/62 | 206/326 |
| 9,394,100 | B2 * | 7/2016 | Glover | B65D 19/12 | |
| 9,493,295 | B2 * | 11/2016 | Glover | B65D 81/052 | |

FOREIGN PATENT DOCUMENTS

| | | |
|---|---|---|
| CN | 105358443 | 2/2016 |
| DE | 19840348 | 3/2000 |
| DE | 10232261 | 2/2003 |
| DE | 102009054037 | 6/2010 |
| DE | 202010014914 | 3/2011 |
| EP | 1464590 | 10/2004 |
| GB | 107982 | 7/1918 |

OTHER PUBLICATIONS

International Patent Application No. PCT/US2014/050256, International Preliminary Report on Patentability dated Feb. 25, 2016.
Europe Application No. 14753428.3, Communication Pursuant to Article 94(3) EPC, dated Mar. 7, 2017.
China Application No. 2014800379251, Office Action and Search Report (and English translation) dated Mar. 13, 2017.

* cited by examiner

MULTIPLE SEAT SHIPPING CONTAINER

CROSS REFERENCE TO RELATED APPLICATIONS

This application is the U.S. national phase entry of International Application Serial No. PCT/US2014/050256 ("the '256 application"), filed on Aug. 8, 2014, which application is related to and claims priority benefits from U.S. Provisional Application Ser. No. 61/864,705 ("the '705 application"), filed on Aug. 12, 2013, entitled TWO SEAT SHIPPING CRATE. The '256 and '705 applications are hereby incorporated in their entireties by this reference.

FIELD OF THE INVENTION

The field of the invention relates to apparatuses and processes related to shipping containers for passenger seats or the like.

BACKGROUND

Many passenger seats such as those on passenger aircraft, buses, trains, and the like are shipped from one location to another. For example, seats may be shipped to an accessory installer or to an installation facility to be installed in a new vehicle or to replace the seats in an existing vehicle.

In certain situations, it may be desirable to package multiple seats into a single shipping container to maximize efficiency related to the number of seats shipped per unit volume while minimizing shipping costs.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a multiple seat shipping container comprises a bottom base structure configured to attach one or more first seats, a forward wall with a lower portion pivotally attached to a forward side of the bottom base structure, a top wall pivotally attached to an upper portion of the forward wall, the top wall configured to attach one or more second seats, and a rear wall attached to a rear side of the bottom base structure, wherein the multiple seat shipping container is configured to fold into a box shape configuration such that the one or more second seats are suspended from the top wall adjacent to the one or more first seats.

In some embodiments, the bottom base structure comprises a riser configured to interface with the forward wall.

The multiple seat shipping container, in certain embodiments, further comprises a left wall pivotally attached to a left side of the bottom base structure and a right wall pivotally attached to a right side of the bottom base structure.

In some embodiments, the forward wall is configured as a bifold panel with the lower portion pivotally attached to the upper portion. The multiple seat shipping container, in certain embodiments, further comprises one or more fold locks for maintaining the forward wall in a deployed non-folded position.

The rear wall of the multiple seat shipping container, in some embodiments, is configured as a bifold panel with a lower portion of the rear wall pivotally attached to an upper portion of the rear wall. In certain embodiments, the one or more rotation assistance mechanisms are gas struts or sprung hinges.

In some embodiments, the multiple seat shipping container further comprises one or more rotation assistance mechanisms configured to control rotation of the top wall with respect to the forward wall.

The multiple seat shipping container, in some embodiments, if the one or more first seats and the one or more second seats are removed, is configured to fold into a compact configuration such that an upper surface of the multiple seat shipping container in the compact configuration is approximately parallel to a lower surface of the bottom base structure. In certain embodiments, a height of the multiple seat shipping container in the compact configuration is approximately twice a height of the bottom base structure.

The multiple seat shipping container, in certain embodiments, further comprises one or more handles on the top wall.

In some embodiments, the multiple seat shipping container further comprises a first modular track mounting system attached to an upper surface of the bottom base structure and a second modular track mounting system attached to a bottom surface of the top wall, wherein the first modular track mounting system is configured to secure the one or more first seats and the second modular track mounting system is configured to secure the one or more second seats.

The multiple seat shipping container, in certain embodiments, further comprises a plurality of pivot latches configured to lock the multiple seat shipping container in the box shape configuration.

According to certain embodiments of the present invention, a multiple seat shipping container comprises a bottom base structure configured to attach one or more first seats, a forward wall with a lower portion pivotally attached to a forward side of the bottom base structure, a top wall pivotally attached to an upper portion of the forward wall, the top wall configured to attach one or more second seats, and a rear wall attached to a rear side of the bottom base structure, wherein the multiple seat shipping container is configured to fold into a box shape configuration with the top wall disposed opposite of the bottom base structure such that the one or more second seats are suspended from the top wall adjacent to the one or more first seats and inverted relative to the one or more first seats.

In some embodiments, the forward wall of the multiple seat shipping container is configured as a bifold panel with the lower portion pivotally attached to the upper portion. The multiple seat shipping container, in certain embodiments, further comprises one or more fold locks for maintaining the forward wall in a deployed non-folded position.

In certain embodiments, the rear wall of the multiple seat shipping container is configured as a bifold panel with a lower portion of the rear wall pivotally attached to an upper portion of the rear wall.

According to certain embodiments of the present invention, a multiple seat shipping container comprises a bottom base structure configured to attach one or more first seats, a forward wall with a lower portion pivotally attached to a forward side of the bottom base structure such that the forward wall is configured as a first bifold panel with the lower portion pivotally attached to an upper portion of the forward wall, a top wall pivotally attached to the upper portion of the forward wall, the top wall configured to attach one or more second seats, a rear wall attached to a rear side of the bottom base structure such that the rear wall is configured as a second bifold panel with a lower portion of the rear wall pivotally attached to an upper portion of the rear wall, and one or more fold locks for maintaining the forward wall and the rear wall in deployed non-folded positions, wherein the multiple seat shipping container is configured to fold into a box shape configuration such that the one or more second seats are suspended from the top wall adjacent to the one or more first seats.

The multiple seat shipping container, in certain embodiments, further comprises one or more rotation assistance mechanisms configured to control rotation of the top wall with respect to the forward wall. In some embodiments, the one or more rotation assistance mechanisms are gas struts or sprung hinges.

DETAILED DESCRIPTION

Figure 1:
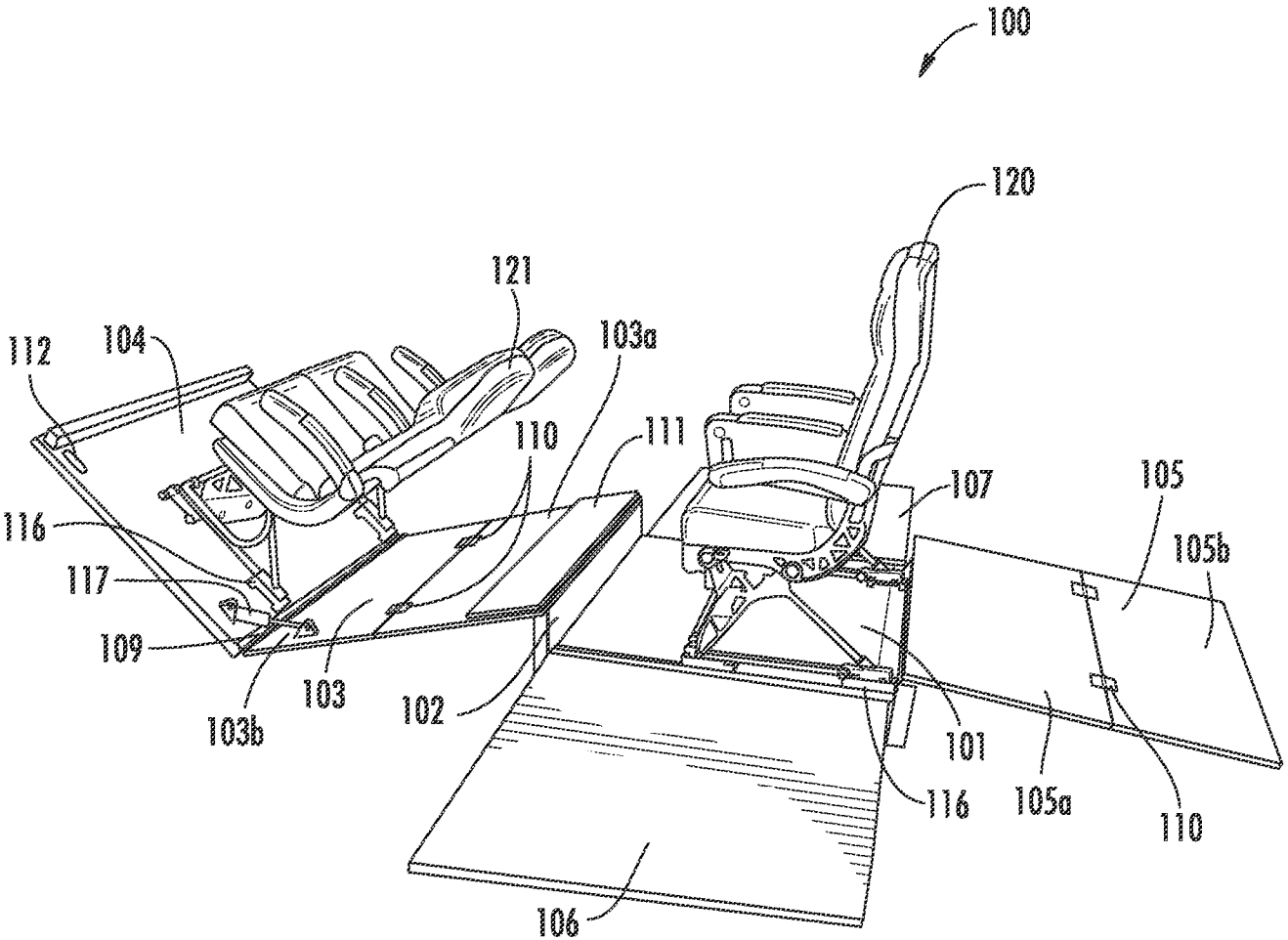
FIG. 1 is a side perspective view of a multiple seat shipping container according to certain embodiments of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1-4 illustrate embodiments of a multiple seat shipping container 100. In these embodiments, the multiple seat shipping container 100 comprises a bottom base structure 101 configured to attach one or more first seats 120, a riser 102 attached to a forward side of the bottom base structure 101, a forward wall 103 with a lower portion 103*a* pivotally attached to the riser 102, a top wall 104 pivotally attached to an upper portion 103*b* of the forward wall 103 where the top wall 104 is configured to attach one or more second seats 121, a rear wall 105 pivotally attached to a rear side of the bottom base structure 101, a left wall 106 pivotally attached to a left side of the bottom base structure 101, and a right wall 107 pivotally attached to a right side of the bottom base structure 101. The multiple seat shipping container 100 is configured to fold into a box shape configuration (see FIGS. 2 and 3) such that the one or more second seats 121 are suspended from the top wall 104 adjacent to the one or more first seats 120. The one or more second seats 121 may be inverted relative to the one or more first seats 120. In some embodiments, the riser 102 may be an integral component of the bottom base structure 101 or the riser 102 may be a separate component. In certain embodiments, the forward wall 103 may be directly pivotally attached to the bottom base structure 101. In some embodiments, the components of the multiple seat shipping container 100 may be configured to provide a seal between the interior and the exterior of the multiple seat shipping container 100.

In an unfolded configuration, as shown in FIG. 1, the rear wall 105, the left wall 106, and the right wall 107 are pivoted down with respect to the bottom base structure 101. In addition, forward wall 103 is pivoted down with respect to riser 102. Top wall 104 can pivot with respect to forward wall 103 including a position where top wall 104 lays flat on the ground to facilitate attachment of the one or more second seats 121. Similarly, when the various walls are unfolded, a user may gain access to bottom base structure 101 to attach the one or more first seats 120. The one or more first seats 120 and the one or more second seats 121 may be attached to their respective walls in various ways. In some embodiments, the upper surface of the bottom base structure 101 and the bottom surface of the top wall 104 may each include a modular track mounting system 116. The modular track mounting system 116 may be compatible with numerous different seats and may include one or more fittings or channels (which may be permanently mounted to the respective wall) configured to attach one or more seats such that the seats can be quickly attached/detached without using tools. To facilitate movement of the top wall 104, the top wall 104 may include one or more handles 112. In some embodiments, handles 112 are recessed cavities which a user may grip when pivoting top wall 104 and/or forward wall 103.

Figure 2:
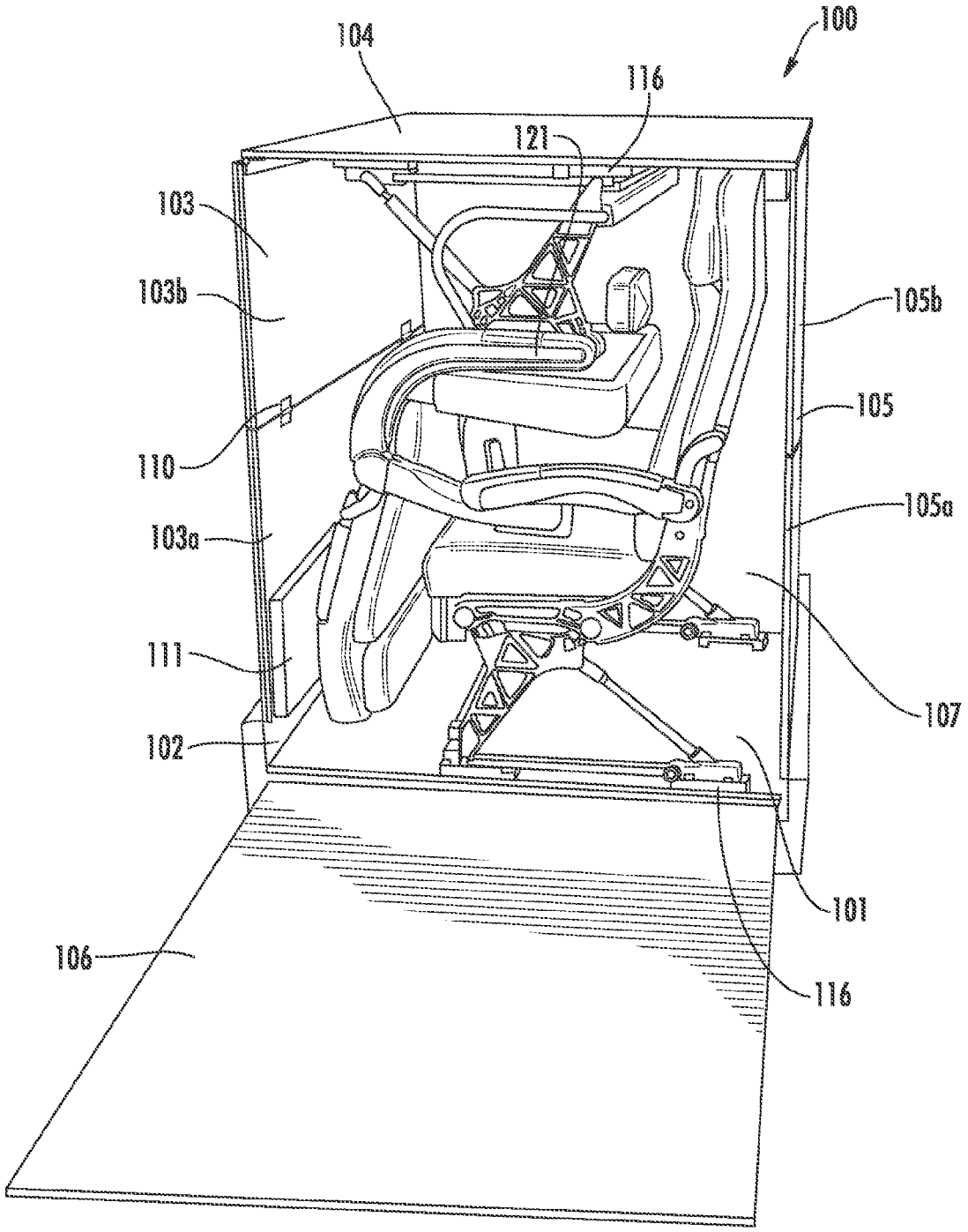
FIG. 2 is a side perspective view of the multiple seat shipping container of FIG. 1 in a box shape configuration with the left wall pivoted down.

Although the one or more first seats 120 and the one or more second seats 121 are each illustrated in FIGS. 1 and 2 as single seat units (each seat unit having two chairs), the multiple seat shipping container 100 may be configured to carry any configuration of or number of seats. For example, the multiple seat shipping container 100 may be configured to carry two additional seats similar to those illustrated (i.e., one additional seat on the bottom base structure 101 and one additional seat on the top wall 104). In some embodiments, the seats may be mounted end-to-end such that the distance between the left wall 106 and the right wall 107 would approximately double. In some embodiments, the additional seats may be mounted side-by-side such that the distance between the forward wall 103 and the rear wall 105 would increase. Furthermore, the multiple seat shipping container 100 may be configured to carry one or more single chair seat units.

Figure 3:
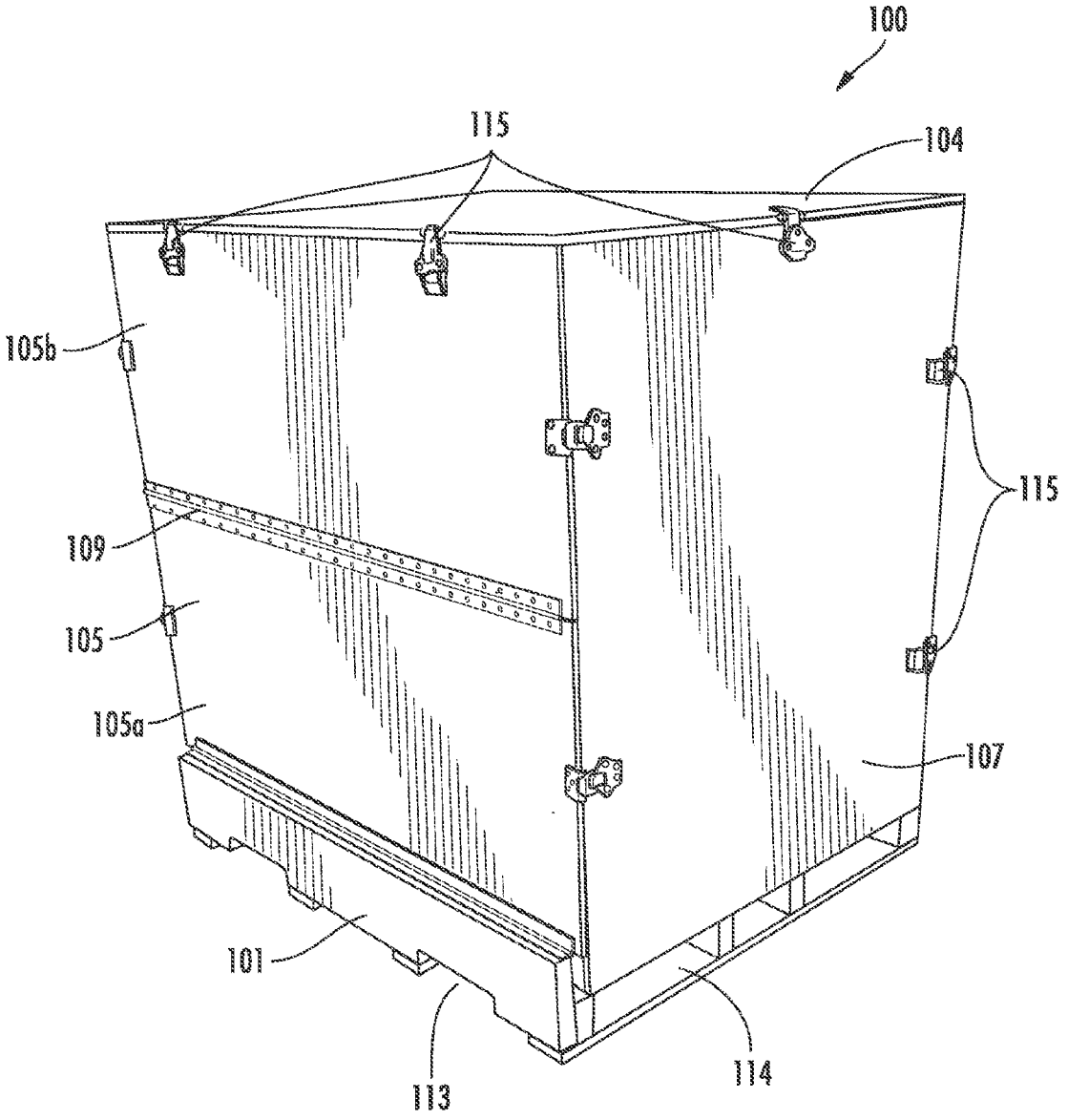
FIG. 3 is a rear perspective view of the multiple seat shipping container of FIG. 1.

Once the one or more first seats 120 and the one or more second seats 121 are attached, the multiple seat shipping container 100 may be readied for transport by folding into the box configuration shown in FIG. 3 where top wall 104 forms the top of the multiple seat shipping container 100. As shown in FIG. 2 (where the multiple seat shipping container 100 is in the box configuration with the exception of left wall 106, which is unfolded to show an interior view of the multiple seat shipping container 100), forward wall 103 and rear wall 105 are disposed vertically and top wall 104 is horizontal and disposed approximately at a 90 degree angle with respect to forward wall 103 (based on movement of hinge 109).

Due to the added weight associated with the one or more second seats 121, top wall 104 may be difficult to fold or unfold. Accordingly, in some embodiments, the multiple seat shipping container 100 may include one or more rotation assistance mechanisms configured to facilitate and control rotation of the top wall 104 with respect to the forward wall 103. The assist mechanism may include a spring within hinge 109 or a strut 117 (see FIG. 1) or a combination thereof. Implementing the one or more rotation assistance mechanisms may prevent damage to the seats (or to the multiple seat shipping container 100) during folding or unfolding processes.

In some embodiments, top wall 104 is secured to upper portion 105*b* of rear wall 105 by one or more fastening devices (the top wall 104 may also include a fastening device at the interface with other walls, such as right wall 107). One example of the one or more fastening devices are pivot latches 115. As shown in FIG. 3, the multiple seat shipping container 100 may include a plurality of pivot latches 115 including those located at the interface between, for example, right wall 107 and rear wall 105, right wall 107 and forward wall 103, and left wall 106 and rear wall 105. FIG. 2 also shows that the one or more second seats 121 are suspended from top wall 104. In some embodiments, the one or more first seats 120 and the one or more second seats 121 are arranged in complementary fashion with respect to one another to minimize interferences. For example, in some embodiments, as shown in FIG. 2, the one or more first seats 120 are mounted closer to the left wall 106 and the one or more second seats 121 are mounted closer to the right wall 107. Such an arrangement ensures that when arm rests of the respective seats are deployed, the arms rests do not interfere with one another and the seats can be arranged in close proximity to one another.

As shown in FIGS. 1 and 2, the forward wall 103 may include a protective pad 111 such that, when forward wall 103 is oriented vertically and top wall 104 is disposed horizontally in the box configuration (see FIG. 2), protective pad 111 is disposed adjacent to a headrest of the one or more second seats 121. The one or more second seats 121 may include an electronic component (such as a video screen or monitor). The upper portion 105*b* of rear wall 105 may also include a protective pad 111 for the interface with the one or more first seats 120.

As shown in FIG. 3, the bottom base structure 101 may include one or more features to allow a forklift to carry the multiple seat shipping container 100. For example, the bottom base structure 101 may include cutouts 113 and/or openings 114. In certain embodiments, bottom base structure 101 is compatible with a forklift while in other embodiments, the bottom base structure 101 is compatible with both forklifts and pallet jacks. In some embodiments, the overall height of multiple seat shipping container 100 (in the box configuration) is designed such that two multiple seat shipping containers 100 may be stacked on top of each other inside a standard box trailer for a semi-trailer truck.

Figure 4:
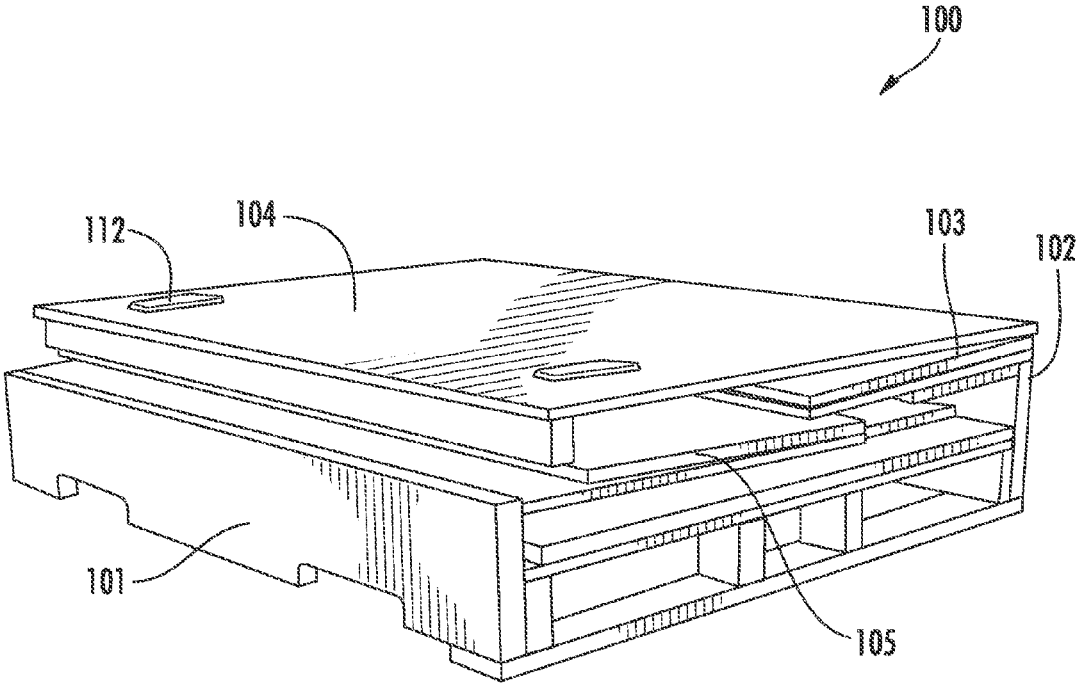
FIG. 4 is a rear perspective view of the multiple seat shipping container of FIG. 1 in a folded compact configuration.

In addition to the unfolded and box configurations shown in FIGS. 1-3, the multiple seat shipping container 100 may also be arranged in a folded compact configuration as shown in FIG. 4. When the one or more first seats 120 and the one or more second seats 121 are removed, the multiple seat shipping container 100 may fold into a more compact shape such as the folded compact configuration shown in FIG. 4. As shown in FIGS. 1 and 2, forward wall 103 is a bifold panel that includes a lower portion 103*a* and an upper portion 103*b* (connected with a hinge 109). In certain embodiments, the hinge 109 is disposed approximately halfway along the length of forward wall 103 such that the lower portion 103*a* and the upper portion 103*b* are approximately the same size. In some embodiments, forward wall 103 includes one or more fold locks 110, which prevent lower portion 103*a* and upper portion 103*b* from folding with respect to one another. In other words, the fold locks 110 maintain forward wall 103 in flat deployed non-folded position as shown in FIGS. 1-3. The one or more fold locks 110 may be any device configured to restrict motion (e.g., rotary motion) of the bifold panel. For example, a fold lock 110 may be a device capable of being selectively engaged (e.g., by inserting a pin) to lock the forward wall in a given position. To shift into the folded compact configuration shown in FIG. 4, the one or more fold locks 110 are released and so that lower portion 103*a* and upper portion 103*b* may fold with respect to one another. Similarly, in some embodiments, rear wall 105 may also include one or more fold locks 110, which prevent lower portion 105*a* and upper portion 105*b* from folding with respect to one another. In other words, the fold locks 110 maintain rear wall 105 in flat deployed shape as shown in FIGS. 1-3. To shift into the folded compact configuration shown in FIG. 4, the one or more fold locks 110 are released and so that lower portion 105*a* and upper portion 105*b* may fold with respect to one another. The left wall 106 and the right wall 107 pivot toward center of multiple seat shipping container 100. In some embodiments, after the left wall 106 and the right wall 107 are located, the rear wall 105 moves to a bifolded condition adjacent to the center of multiple seat shipping container 100. Due to the height of riser 102, forward wall 103 may be positioned in a bifolded condition above rear wall 105 (see FIG. 4).

Top wall 104, which is pivotally attached to forward wall 103 may be positioned above forward wall 103 in the folded compact configuration as shown in FIG. 4. The multiple seat shipping container 100 may be arranged in the folded compact configuration such that the upper surface of top wall 104 is horizontal and/or parallel to the lower surface of the bottom base structure 101. Accordingly, when arranged in the folded compact configuration, numerous multiple seat shipping containers 100 may be efficiently stacked on one another. In some embodiments, the height of the multiple seat shipping container 100 in the compact configuration is approximately twice the height of the bottom base structure 101.

Although FIG. 1 shows rear wall 105 folded down adjacent to the ground, in some embodiments, to simplify and reduce weight of the multiple seat shipping container 100, the rear wall 105 may be permanently attached to bottom base structure 101 such that rear wall is permanently oriented in a vertical orientation. In addition, in certain embodiments, the multiple seat shipping container 100 may be configured without the left wall 106 and/or the right wall 107. Assuming other components of the multiple seat shipping container 100 are capable of reacting and distributing the applicable loads (i.e., the bottom base structure 101, the forward wall 103, the top wall 104, the rear wall 105, and any relevant connecting/fastening devices), the left wall 106 and/or the right wall 107 may be removed or replaced with non-structural components such as a fabric curtain or plastic sheet. Removal of the left wall 106 and/or the right wall 107 may require additional structural components such as corner brackets or braces. The non-structural component may be configured to provide a seal between the interior and the exterior of the multiple seat shipping container 100.

The components of the multiple seat shipping container 100 may be formed of materials including, but not limited to, plastic, thermoplastic, steel, aluminum, stainless steel, other plastic or polymer materials, other metallic materials, composite materials, wood, or other similar materials. Moreover, the components of the multiple seat shipping container 100 may be attached to one another via suitable fasteners, which include, but are not limited to, screws, bolts, rivets or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A multiple seat shipping container comprising:

a box configuration and a compact configuration;

a bottom base structure comprising at least two tracks for attaching one or more first seats;

a forward wall with a lower portion pivotally attached to a forward side of the bottom base structure;

a left wall pivotally attached to a left side of the bottom base structure;

a right wall pivotally attached to a right side of the bottom base structure;

a top wall pivotally attached to an upper portion of the forward wall, the top wall comprising at least two tracks for attaching one or more second seats; and a rear wall attached to a rear side of the bottom base structure, wherein when the multiple seat shipping container is in the box configuration, the one or more second seats are suspended from the top wall adjacent to the one or more first seats.

2. The multiple seat shipping container of claim 1, wherein the bottom base structure comprises a riser configured to interface with the forward wall.

3. The multiple seat shipping container of claim 1, wherein:

the left wall and the right wall are attached at a first vertical distance from an upper surface of the bottom base structure;

the rear wall is attached at a second vertical distance from the upper surface of the bottom base structure;

the forward wall is attached at a third vertical distance from the upper surface of the bottom base structure;

the third vertical distance is greater than the second vertical distance; and the second vertical distance is greater than the first vertical distance.

4. The multiple seat shipping container of claim 1, wherein the forward wall is configured as a bifold panel with the lower portion pivotally attached to the upper portion.

5. The multiple seat shipping container of claim 4, further comprising one or more fold locks for maintaining the forward wall in a deployed non-folded position.

6. The multiple seat shipping container of claim 1, wherein the rear wall is configured as a bifold panel with a lower portion of the rear wall pivotally attached to an upper portion of the rear wall.

7. The multiple seat shipping container of claim 1, further comprising one or more rotation assistance mechanisms configured to control rotation of the top wall with respect to the forward wall.

8. The multiple seat shipping container of claim 7, wherein the one or more rotation assistance mechanisms are gas struts or sprung hinges.

9. The multiple seat shipping container of claim 1, wherein, when the one or more first seats and the one or more second seats are removed, the multiple seat shipping container folds into the compact configuration such that an upper surface of the multiple seat shipping container in the compact configuration is approximately parallel to a lower surface of the bottom base structure.

10. The multiple seat shipping container of claim 9, wherein a height of the multiple seat shipping container in the compact configuration is approximately twice a height of the bottom base structure.

11. The multiple seat shipping container of claim 1, further comprising one or more handles on the top wall.

12. The multiple seat shipping container of claim 1, wherein the one or more first seats are attached to the bottom base structure and are offset closer to the left wall and the one or more second seats are attached to the top wall and are offset closer to the right wall.

13. The multiple seat shipping container of claim 1, further comprising a plurality of pivot latches configured to lock the multiple seat shipping container in the box configuration.

14. A multiple seat shipping container comprising:

a bottom base structure comprising at least two tracks for attaching one or more first seats;

a forward wall comprising a lower portion and an upper portion wherein the lower portion is pivotally attached to a forward side of the bottom base structure;

a left wall pivotally attached to a left side of the bottom base structure;

a right wall pivotally attached to a right side of the bottom base structure;

a top wall pivotally attached to the upper portion of the forward wall, the top wall comprising at least two tracks for attaching one or more second seats; and a rear wall attached to a rear side of the bottom base structure, wherein the multiple seat shipping container is configured to fold into a box shape configuration with the top wall disposed opposite of the bottom base structure such that the one or more second seats are suspended from the top wall adjacent to the one or more first seats and inverted relative to the one or more first seats, and wherein the forward wall is configured as a bifold panel with the lower portion pivotally attached to the upper portion.

15. The multiple seat shipping container of claim 14, wherein the multiple seat shipping container, in addition to the box shape configuration, comprises:

(i) a compact configuration wherein the left and right walls are folded onto the bottom base structure, the rear wall is folded onto the left and right walls, the forward wall is folded onto the rear wall, and the top wall is folded onto the forward wall; and (ii) an unfolded configuration wherein the forward wall, the left wall, the right wall, and the rear wall are each (a) folded away from the bottom base structure and (b) contact a ground surface when in the unfolded configuration.

16. The multiple seat shipping container of claim 14, further comprising one or more fold locks for maintaining the forward wall in a deployed non-folded position.

17. The multiple seat shipping container of claim 14, wherein the rear wall is configured as a bifold panel with a lower portion of the rear wall pivotally attached to an upper portion of the rear wall.

18. A multiple seat shipping container comprising:

a bottom base structure comprising at least two tracks;

one or more first seats attached to the at least two tracks of the bottom base structure;

a forward wall with a lower portion pivotally attached to a forward side of the bottom base structure such that the forward wall is configured as a first bifold panel with the lower portion pivotally attached to an upper portion of the forward wall;

a left wall pivotally attached to a left side of the bottom base structure;

a right wall pivotally attached to a right side of the bottom base structure;

a top wall pivotally attached to the upper portion of the forward wall, the top wall comprising at least two tracks;

one or more second seats attached to the at least two tracks of the top wall;

a rear wall attached to a rear side of the bottom base structure such that the rear wall is configured as a second bifold panel with a lower portion of the rear wall pivotally attached to an upper portion of the rear wall; and one or more fold locks for maintaining the forward wall and the rear wall in deployed non-folded positions, wherein:

the multiple seat shipping container is configured to fold into a box shape configuration such that the one or more second seats are suspended from the top wall adjacent to the one or more first seats;

the left wall and the right wall are attached at a first vertical distance from an upper surface of the bottom base structure;

the rear wall is attached at a second vertical distance from the upper surface of the bottom base structure;

the forward wall is attached at a third vertical distance from the upper surface of the bottom base structure;

the third vertical distance is greater than the second vertical distance; and the second vertical distance is greater than the first vertical distance.

19. The multiple seat shipping container of claim 18, further comprising one or more rotation assistance mechanisms configured to control rotation of the top wall with respect to the forward wall.

20. The multiple seat shipping container of claim 19, wherein the one or more rotation assistance mechanisms are gas struts or sprung hinges.

* * * * *